United States Patent [19]

Seebo, II

[11] 4,286,508

[45] Sep. 1, 1981

[54] COMBINATION STAIRCASE AND ATTIC FAN MEANS

[76] Inventor: Thomas C. Seebo, II, 1641 Kildonan Pl., Cary, N.C. 27511

[21] Appl. No.: 185,019

[22] Filed: Sep. 8, 1980

[51] Int. Cl.[3] ..... F24F 7/00; E04F 11/06

[52] U.S. Cl. ..... 98/43 R; 74/89.15; 74/471 R; 182/78

[58] Field of Search ..... 98/33 R, 43 R; 182/77, 182/78, 79, 80, 81; 416/146 R; 49/73, 143; 74/89.15, 471 R

[56] References Cited

U.S. PATENT DOCUMENTS

| | | | |
|---|---|---|---|
| 1,696,344 | 12/1928 | Clark | 74/89.15 |
| 1,811,709 | 6/1931 | Bessler | 182/80 |
| 2,087,637 | 7/1937 | Burt | 98/43 R |
| 2,496,773 | 2/1950 | Brown | 98/43 R |

FOREIGN PATENT DOCUMENTS

| | | | |
|---|---|---|---|
| 638177 | 5/1950 | United Kingdom | 182/78 |

*Primary Examiner*—Albert J. Makay

*Assistant Examiner*—Harold Joyce

*Attorney, Agent, or Firm*—Mills and Coats

[57] ABSTRACT

The present invention entails a combination staircase and attic fan assembly designed to share a common attic opening formed within a structure. There is provided a foldable staircase assembly that is mounted adjacent said attic opening and movable between a first operative position within said attic opening to a second remote position outside the plane of said attic opening. In addition there is provided an attic fan assembly that is movably mounted adjacent said attic opening and movable from a first operative position within said attic opening to a second remote position outside of said attic opening. A connecting link is operatively interconnected between said staircase assembly and said attic fan assembly for moving the two in unison. Further there is provided a drive system for driving both the staircase assembly and attic for assembly between their respective positions such that when said staircase assembly assumes said first operative position said attic fan assembly is disposed in its second inoperative position and vice versa.

8 Claims, 4 Drawing Figures

COMBINATION STAIRCASE AND ATTIC FAN MEANS

FIELD OF INVENTION

The present invention relates to static structures, and particularly to combination staircase devices found in static structures, and more particularly to a cooperative staircase-attic fan assembly adapted to utilize the same common attic opening.

BACKGROUND OF INVENTION

The rising cost of energy and the need for conserving energy has led many homebuilders and homeowners to take steps to make their homes more energy efficient. Homes are now, for example, better insulated, some are being provided with solar energy, and more efficient heating and cooling systems are being installed.

Attic fans that exhaust hot air from the attic portion of a home, cooling the attic in the process, enables the home or structure to be cooled more efficiently. Attic fans of this type are often installed in the roof or adjacent the gable end of a home, and by simply circulating air through the attic, the attic fan has the effect of exhausting hot air from the attic and generally cooling the same. By providing such an attic fan with an automatic thermostat control, the cooling efficiency of the attic fan can be enhanced.

Certain other types of attic fan assemblies accomplish cooling of both the attic and house by drawing air through the house, through a hole in the ceiling and then through the attic. These fan assemblies are normally mounted in the ceiling of the house near the center of the structure to get maximum air flow through all portions of the house. These ceiling mounted attic fans allow heat transfer between living area and attic even when not in use. This is because the ceiling mounted attic fan traditionally has had lightweight shutters installed to seal the house from the attic area. During the winter, the owner must climb up into the attic and install an insulation cover to prevent excessive heat loss through the fan opening. In the end, the difficulties involved in installation and operation have discouraged the utilization of attic fans.

SUMMARY OF INVENTION

The present invention entails a combination staircase and attic fan assembly that is adapted to be mounted about an attic opening within a structure. Included about the attic opening is both a staircase assembly and an attic fan assembly with the two being operatively interconnected and controlled such that either may assume an operative position about the attic opening while the other is disposed in a nonoperative remote position with respect to the attic opening. Consequently, the attic opening not only functions to house a staircase assembly and to permit access into the attic but further functions as a mounting place for an attic fan.

It is, therefore, a primary object of the present invention to provide a ceiling mounted attic fan for cooling both the attic and living areas of a house that overcomes the problems of undesirable heat transfer between the attic and living areas commonly found in conventional installations.

A further object of the present invention is to provide a combination staircase-ceiling mounted attic fan assembly of the character referred to above that minimizes the combined ceiling area required for an attic staircase assembly and an attic fan.

It is also an object of the present invention to provide an attic fan assembly that can be conveniently installed in a new or existing dwelling, and which overcomes many of the problems of placing and mounting associated with attic fans of the prior art.

A further object of the present invention resides in the provision of an attic fan assembly that is provided in conjunction with an attic staircase assembly to form a combination staircase-attic fan assembly adapted to be mounted about a common attic opening and wherein both said staircase assembly and attic fan assembly is adapted to move between an operative and inoperative position and further operatively interconnected such that when one is in the operative position about the attic opening the other is disposed in an inoperative position and vice versa.

Still a further object of the present invention resides in the provision of a combination staircase-attic fan assembly for use in conjunction with a single attic opening provided within a residential type dwelling, wherein the staircase assembly and an attic fan assembly are operatively interconnected for control movement in unison and wherein the combination assembly is provided with automatic drive control means for moving each assembly between operative and inoperative positions wherein in the operative position each assembly is disposed about the attic opening where the same may be functional.

It is also an object of the present invention to provide a combination staircase-attic fan assembly of the character described above wherein the same is comprised of two basic assemblies, one being a staircase assembly and the other being the attic fan assembly, wherein one assembly is pivotably mounted about a transverse axis about the attic opening while the other assembly is adapted to move fore-and-aftly with respect to the attic opening.

Other objects and advantages of the present invention will become apparent from a study of the following description and the accompanying drawings which are merely illustrative of the present invention.

COMBINATION STAIRCASE-ATTIC FAN ASSEMBLY

Figure 1:
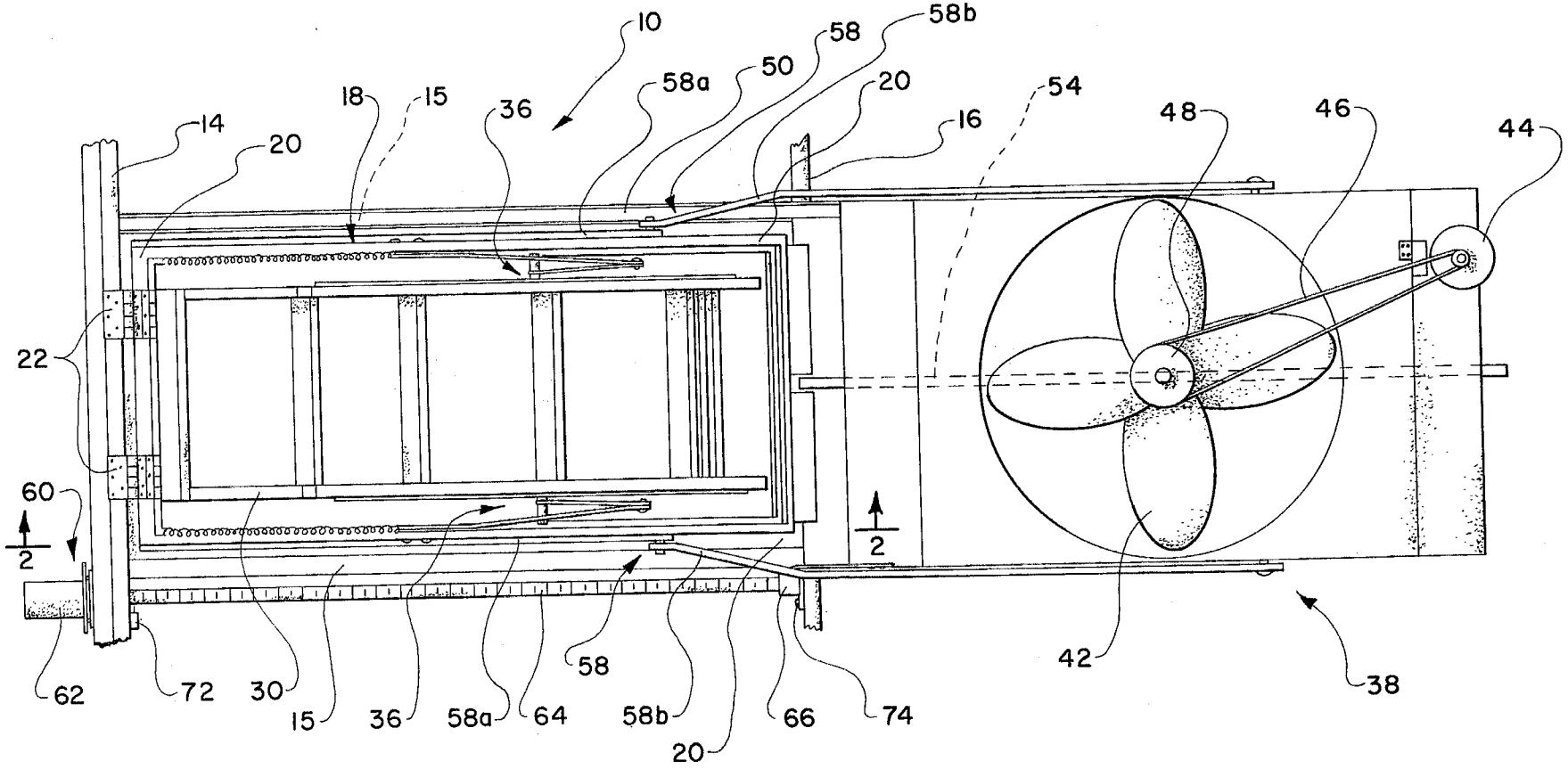
FIG. 1 is a top plan view of the combination staircase-attic fan assembly of the present invention with the staircase assembly being disposed in its operative position.

With further reference to the drawings, the combination staircase-attic fan assembly of the present invention is shown therein and indicated generally by the numeral 10. The staircase-attic fan assembly 10 of the present invention is designed to be utilized about an attic opening, indicated generally by the numeral 12, formed within a residential dwelling.

As shown in the drawings, attic opening 12 is of a conventional box frame type wherein the same is formed about the ceiling joist of a structure and as such would include end headers 14 and 16 joined by longitudinally extending side members 15 to form the box type attic opening 12.

Figures 2, 3, 4:
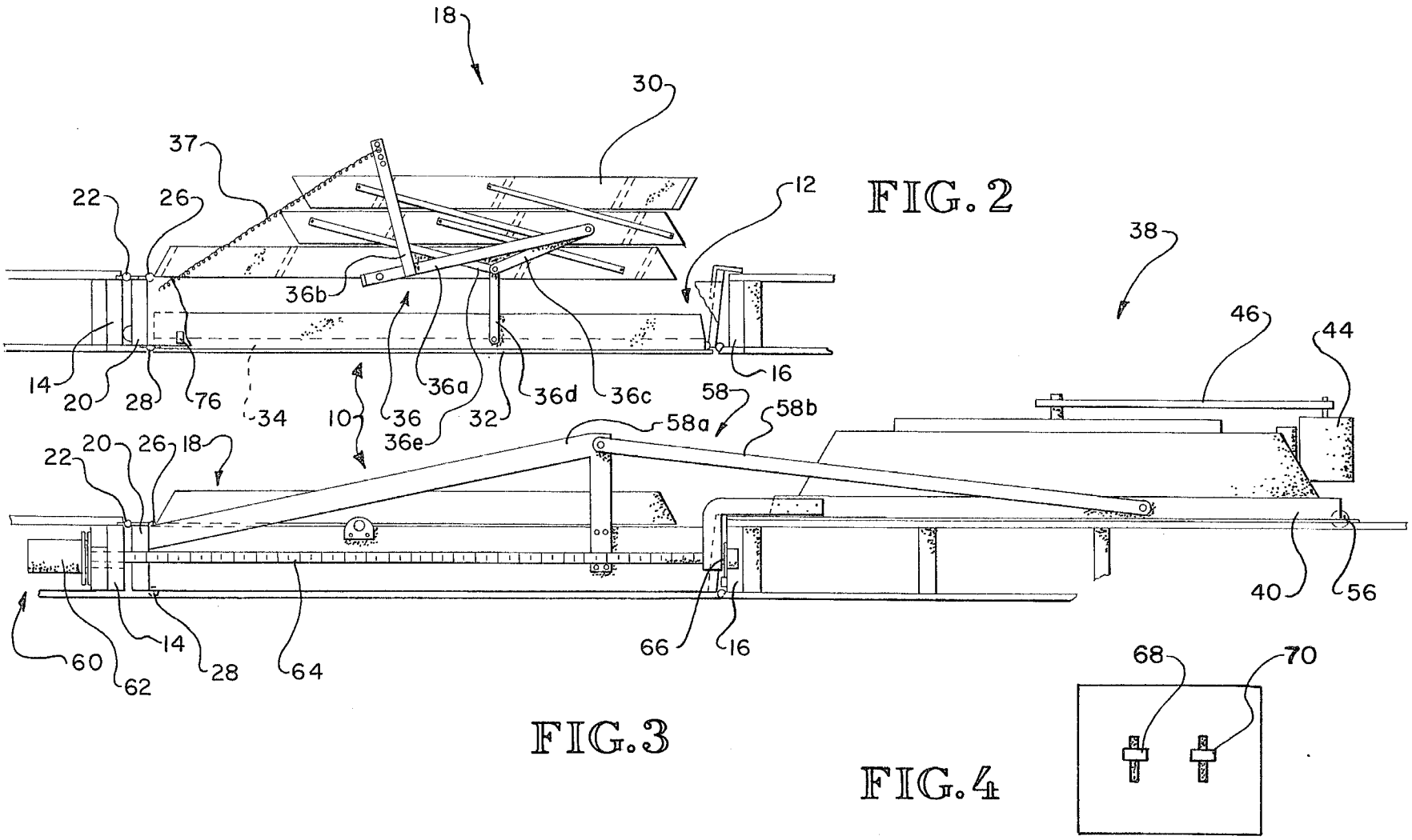
FIG. 2 is a side sectional view taken along the lines 2—2 of FIG. 1.
FIG. 3 is a side elevational view of the combination staircase-attic fan assembly of the present invention with the staircase assembly being disposed again in its operative position.
FIG. 4 is a schematic illustration of a basic control panel for the combination staircase-attic fan assembly of the present invention.

Pivotably mounted about one end of the attic opening 12 is a staircase assembly indicated generally by the numeral 18. Staircase assembly 18 is of a conventional attic staircase type and includes an outer box frame 20 that is secured within attic opening 12 by a major mounting hinge assembly 22 (FIG. 1). Major mounting hinge assembly 22 allows the staircase assembly 18 to assume a first operative position within attic opening 12, as illustrated in FIGS. 1–3, and to rotate counterclockwise about the axis of the major hinge assembly 22 to a second position generally out of the plane of attic opening 12. It is appreciated that major mounting hinges 22 are operatively interconnected between one end of the staircase box frame 20 and the end header 14 of the attic opening 12.

Continuing to refer to staircase assembly 18, it is appreciated that the same would include a ladder assembly that includes a trifold stair assembly 30. This ladder assembly forming a part of the staircase assembly 18 is conventional inasmuch as the same is springed loaded to assume a horizontal closed position as indicated by FIGS. 1–3, but which is operative to be lowered from the attic opening 12 by a pair of lowering hinges 26 and 28. Hinge 26 is operatively connected between the box frame 20 of the staircase assembly 18 and the actual ladder assembly 30. Hinge 28 is operatively connected between box frame 20 of the staircase assembly 18 and access door 32.

As a part of the staircase assembly 18, there is provided a lower entry door 32 with an insulated backing 34 that is secured adjacent the trifold stairs 30. The ladder assembly is supported within staircase or box frame 20 by a pair of laterally spaced spring biased linkage assemblies, each linkage assembly indicated generally by the numeral 36 and particularly shown in FIG. 2. Each linkage assembly includes a pivot link **36*a* that is pivotably mounted to a respective side member of said staircase box frame 20, and wherein there is provided a spring linkage arm 36*b* extending therefrom. An interconnecting link 36*c* is pivotably connected to an end portion of the pivot link 36*a*, and interconnecting link 36*b* is in turn pivotably connected to both a support link 36*d* that connects to door assembly 32, and a ladder connecting link 36*e* that is connected to the trifold stair assembly 30**.

A spring 37 is operatively connected between spring link **36*b* and the box frame 20 of the staircase assembly 18. Spring 37 biases the ladder assembly and access door 32 to its normal horizontal closed position as shown in FIG. 2. It is appreciated, however, that the spring biased linkage assembly 36 just referred to is operative to allow the entire ladder assembly to be rotated generally clockwise as viewed in FIG. 2 to where the trifold stairs 30** can be extended in conventional fashion in order that the stairs can be used to gain access to the attic.

Also operatively associated with attic opening 12 is an attic fan assembly indicated generally by the numeral 38. Attic fan assembly 38 is mounted generally over attic opening 12 and adjacent staircase assembly 18 and includes a main frame or panel assembly 40 that is provided with fan means 42 and which is driven by an electric motor 44 mounted within the frame structure 40. A belt drive 46 is operatively interconnected between the motor 44 and a drive sheave 48 for driving the fan 42.

Attic fan assembly 38 is designed to move longitudinally back and forth over attic opening 12 and over an area adjacent thereto. To provide for this longitudinal back and forth movement, there is provided at least one side guide rail 50 which forms a longitudinal track for the attic fan frame structure 40 to move therein. As viewed in FIG. 1, only one side guide rail 50 is shown. It is appreciated, however, that if desired a like side guide rail 50 could be provided about the opposite side of staircase box frame 20. In addition to give additional stability and to guide the main frame structure 40, there is provided a roller guide channel 54 that is adapted to receive a roller 56 that extends from the main support panel assembly 40.

As viewed in the drawings, it is seen that the attic fan assembly 38 is operative to move from an operative position over attic opening 12 to an inoperative position to the right of attic opening 12.

The present invention contemplates the simultaneous movement of both staircase assembly 18 and attic fan assembly 38. In essence it is desirable for one assembly to move into an operative mode while the other assembly is leaving the operative mode, and vice versa.

To achieve this, the present invention is provided with drive means, indicated generally by the numeral 60, for simultaneously moving staircase assembly 18 from an operative to an inoperative position while moving said attic fan assembly from an inoperative position to its operative position, and vice versa. In particular, said drive means 60 includes an electric motor 62 mounted adjacent said attic opening 12 and operative to drive an elongated jacket screw 64 that is threaded within a jack screw carriage 66 connected to the attic fan assembly 38 and particularly the main panel structure 40 thereof. It is thusly appreciated that the actuation of jack screw 64 will result in the main panel structure 40 of the attic fan assembly 38 moving back and forth.

The main panel structure 40 of the attic fan assembly 38 is connected to the staircase assembly 18 via interconnecting linkage 58. As seen in FIG. 3, this interconnecting linkage 58 includes an attaching link **58*a* that is connected to an interconnecting link 58*b* that is in turn connected to the attic fan frame structure 40. Thus it follows that the movement of the attic fan assembly 38 will cause the staircase assembly 18 to pivot about the axis of major mounting hinge assembly 22**.

There are essentially two controls involved with the combination staircase-attic fan assembly 10. First, there is a mode switch 68 which is operative to actuate electric motor 62 and which effectively determines which of the two assemblies assume the operative mode. Next, there is provided a fan switch 70 for actuating fan motor 44 and it is appreciated that this switch may include a circuit which would only allow fan motor 44 to be actuated in response to the attic fan assembly 38 assuming its operative position within attic opening 12. Further there is provided deactuating microswitches 72 and 74 for effectively switching motor 62 off once either the staircase or fan assembly assumes an operative position over the attic opening (FIG. 1). In addition, there is provided a safety microswitch 76 (FIG. 2) which only permits the actuation of motor 62 when the staircase ladder assembly is in the closed horizontal position as shown in FIGS. 2 and 3.

In operation, it is appreciated that an individual may choose either the staircase assembly 18 or the attic fan assembly 38 to assume an operative position. In the case where the staircase assembly 18 assumes an operative position within the attic opening 12, it is appreciated that access can be gained to the attic of the particular structure by simply lowering the access door 32 and the trifold stair 30. During parts of the year where the operation of attic fan assembly 38 would be advantageous, the staircase assembly 18 would be rotated counterclockwise as viewed in FIG. 2 to its inoperative position and the attic fan assembly 38 would assume its operative position over the attic opening 12. During the summer months, it is contemplated that the attic fan assembly 38 would assume this operative position unless access was desired to the attic, in which case this could be achieved by simply actuating mode control switch 68. When attic fan assembly 38 assumes the operative position over attic opening 12, it is appreciated that the lower or exposed side of the main frame or panel structure 40 could be painted or designed to blend with the surrounding ceiling structure in and around the area of the attic opening 12.

From the foregoing specification, it is appreciated that the present invention entails a new and unique combination staircase-attic fan assembly that overcomes many of the installation disadvantages of attic fans known and used in the prior art. In particular, it must be stressed that the already existing attic opening within a residential dwelling serves as a convenient and efficient mounting place for the attic fan which in the present disclosure is cooperatively provided with an attic staircase assembly. Moreover, the present invention is relatively simple, reliable and can be utilized in both old and new construction.

The present invention, of course, may be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A combination staircase-attic fan assembly adapted to be utilized in conjunction with an attic opening formed within a structure wherein in one mode the attic fan assumes a position in said attic opening and is operative to exhaust air from the attic portion of the structure and in a second mode the staircase is operative to assume a position in said attic opening for providing access to the attic, said combination staircase-attic fan assembly comprising: a staircase assembly; mounting means for movably mounting said staircase assembly about said attic opening for movement between a first operative position within said attic opening wherein the staircase may be lowered for access to said attic, and a second position where said staircase is located remotely from said first operative position; a fan assembly having means for movably mounting the same about said attic opening for movement between a first operative position within said attic opening wherein when actuated said fan assembly is operative to induce air from portions of said structure below said attic, through the attic opening, and on through the attic where the air is exhausted therefrom, and a second position remotely located from said first operative position of said fan assembly; coupling means operatively interconnected between said staircase assembly and said fan assembly for moving the two in unison such that movement of said staircase assembly from said second position to said first operative position results in said fan assembly being moved from its first operative position to its second position and vice versa; and drive means operatively associated with said staircase-fan assembly for driving the staircase assembly and fan assembly between their respective positions.

2. The combination staircase-attic fan assembly of claim 1 wherein said mounting means for moving said staircase assembly between said first and second positions includes a pivot axis about which said staircase assembly moves about as the same is moved between said first and second positions.

3. The combination staircase-attic fan assembly of claim 2 wherein said mounting means for enabling said fan assembly to move between said first and second positions comprises guide rail means for guiding said fan assembly for movement about a horizontal plane as the same moves between said first and second positions.

4. The combination staircase-attic fan assembly of claim 2 wherein said fan assembly includes a horizontal panel and fan means mounted therein.

5. The combination staircase-attic fan assembly of claim 2 wherein said coupler means includes a connecting link connected to said staircase assembly and to said fan assembly wherein as said fan assembly moves back and forth said connecting link is operative to pivot said staircase assembly about said axis.

6. The combination staircase-attic fan assembly of claim 5 wherein said drive means includes a jack screw disposed adjacent said staircase-attic fan assembly and operatively associated with a jack screw carriage connected to said staircase-attic fan assembly wherein the rotation of said jack screw results in said staircase assembly and attic fan assembly being moved in unison.

7. The combination staircase-attic fan assembly of claim 6 wherein said drive means further includes a reversible electric motor operatively connected to said jack screw for driving the same and consequently driving said staircase assembly and said attic fan assembly between their respective positions.

8. The combination staircase-attic fan assembly of claim 4 wherein said fan assembly further includes roller means that supports said horizontal panel, and a roller guide channel extending horizontally about said attic opening for guiding said attic fan assembly as the same is moved back and forth between its first and second positions.

* * * * *